US005447138A

United States Patent [19]

Barnes

[11] Patent Number: 5,447,138

[45] Date of Patent: Sep. 5, 1995

[54] METHOD FOR CONTROLLING A HYDRAULICALLY-ACTUATED FUEL INJECTIONS SYSTEM TO START AN ENGINE

[75] Inventor: Travis E. Barnes, Peoria, Ill.

[73] Assignee: Caterpillar, Inc., Peoria, Ill.

[21] Appl. No.: 282,840

[22] Filed: Jul. 29, 1994

[51] Int. Cl.[6] ..... F02M 7/00; F02M 37/04

[52] U.S. Cl. ..... 123/446; 123/179.17; 123/496

[58] Field of Search ..... 123/446, 496, 179.17, 123/458

[56] References Cited

U.S. PATENT DOCUMENTS

| | | | |
|---|---|---|---|
| Re. 33,270 | 7/1990 | Beck et al. | 123/447 |
| 4,368,705 | 1/1983 | Stevenson et al. | 123/357 |
| 4,870,939 | 10/1989 | Ishikawa et al. | 123/506 |
| 5,024,200 | 6/1991 | Free et al. | 123/501 |
| 5,056,488 | 10/1991 | Eckert | 123/496 |
| 5,094,215 | 3/1992 | Gustafson | 123/496 |
| 5,094,216 | 3/1992 | Miyaki | 123/496 |
| 5,143,291 | 9/1992 | Grinsteiner | 239/88 |
| 5,152,266 | 10/1992 | Sekiguchi et al. | 123/357 |
| 5,156,132 | 10/1992 | Iwanaga | 123/496 |
| 5,168,855 | 12/1992 | Stone | 123/446 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,245,970 | 9/1993 | Iwaszkiewicz et al. | 123/447 |
| 5,313,924 | 5/1994 | Regueiro | 123/456 |
| 5,345,916 | 9/1994 | Amann et al. | 123/496 |
| 5,357,912 | 10/1994 | Barnes | 123/446 |

FOREIGN PATENT DOCUMENTS 0149598 7/1985 European Pat. Off. .

OTHER PUBLICATIONS

Patent Appln. No. 08/023,279, Filed Feb. 26, 1993, Entitled "Electronic Control System and Method for a Hydraulically-Actuated Fuel Injection System", Travis E. Barnes, Docket No. 92-105.

Sae Paper No. 930270, "Heui—A New Direction for Diesel Engine Fuel Systems", Glassey et al., International Congress and Exposition, Detroit, Mich., Mar. 1-5, 1993.

Sae Paper No. 930271, "Development of the Heui Fuel System—Integration of Design, Simulation, Test, and Manufacturing", Stockner et al., International Congress and Exposition, Detroit, Mich., Mar. 1-5, 1993.

Sae Paper No. 940586, "Benefits of New Fuel Injection System Technology on Cold Startability of Diesel Engines—Improvement of Cold Startability and White Smoke Reduction by Means of Multi Injection with Common Rail Fuel System (ECD-U2)", Osuka et al., International Congress and Exposition, Detroit, Mich., Feb. 28-Mar. 3, 1994.

*Primary Examiner*—Thomas N. Moulis

*Attorney, Agent, or Firm*—David M. Masterson

[57] ABSTRACT

In one aspect of the present invention, a method is disclosed that controls the pressure of actuating fluid supplied to a hydraulically-actuated injector. A target engine speed acceleration is determined, and compared to the actual engine speed acceleration to determine a desired actuating fluid pressure in order to control the fuel injection rate to start the engine.

6 Claims, 4 Drawing Sheets

METHOD FOR CONTROLLING A HYDRAULICALLY-ACTUATED FUEL INJECTIONS SYSTEM TO START AN ENGINE

TECHNICAL FIELD

The present invention relates generally to hydraulically-actuated fuel injection systems and, more particularly to electronic control systems for independently controlling the fuel injection rate and duration to start an engine.

1. Background Art

A diesel engine achieves combustion by injecting fuel that vaporizes into the hot air of an engine cylinder. However, during cold starting conditions, the air loses much of its heat to the cylinder walls making engine starting difficult. For example, if too much fuel is injected into the cylinder, the heat required to vaporize the cold fuel reduces the air temperature and may prevent or quench combustion. However, when the engine has fired and is accelerating to running speed, the fuel injection rate must be increased in order to inject the fuel within the proper crank angle orientation. It is then critical that fuel be injected at a rate which is not too slow that inhibits acceleration, nor too fast that quenches the combustion.

The present invention is directed to overcoming one or more of the problems as set forth above.

2. Disclosure of the Invention

In one aspect of the present invention, a method is disclosed that controls the pressure of actuating fluid supplied to a hydraulically-actuated injector. A target engine speed acceleration is determined, and compared to the actual engine speed acceleration to determine a desired actuating fluid pressure in order to control the fuel injection rate to start the engine.

BEST MODE FOR CARRYING OUT THE INVENTION

The present invention relates to an electronic control system for use in connection with a hydraulically actuated electronically controlled unit injector fuel system. Hydraulically actuated electronically controlled unit injector fuel systems are known in the art. One example of such a system is shown in U.S. Pat. No. 5,191,867, issued to Glassey on Mar. 9, 1993, the disclosure of which is incorporated herein by reference.

Figure 1:
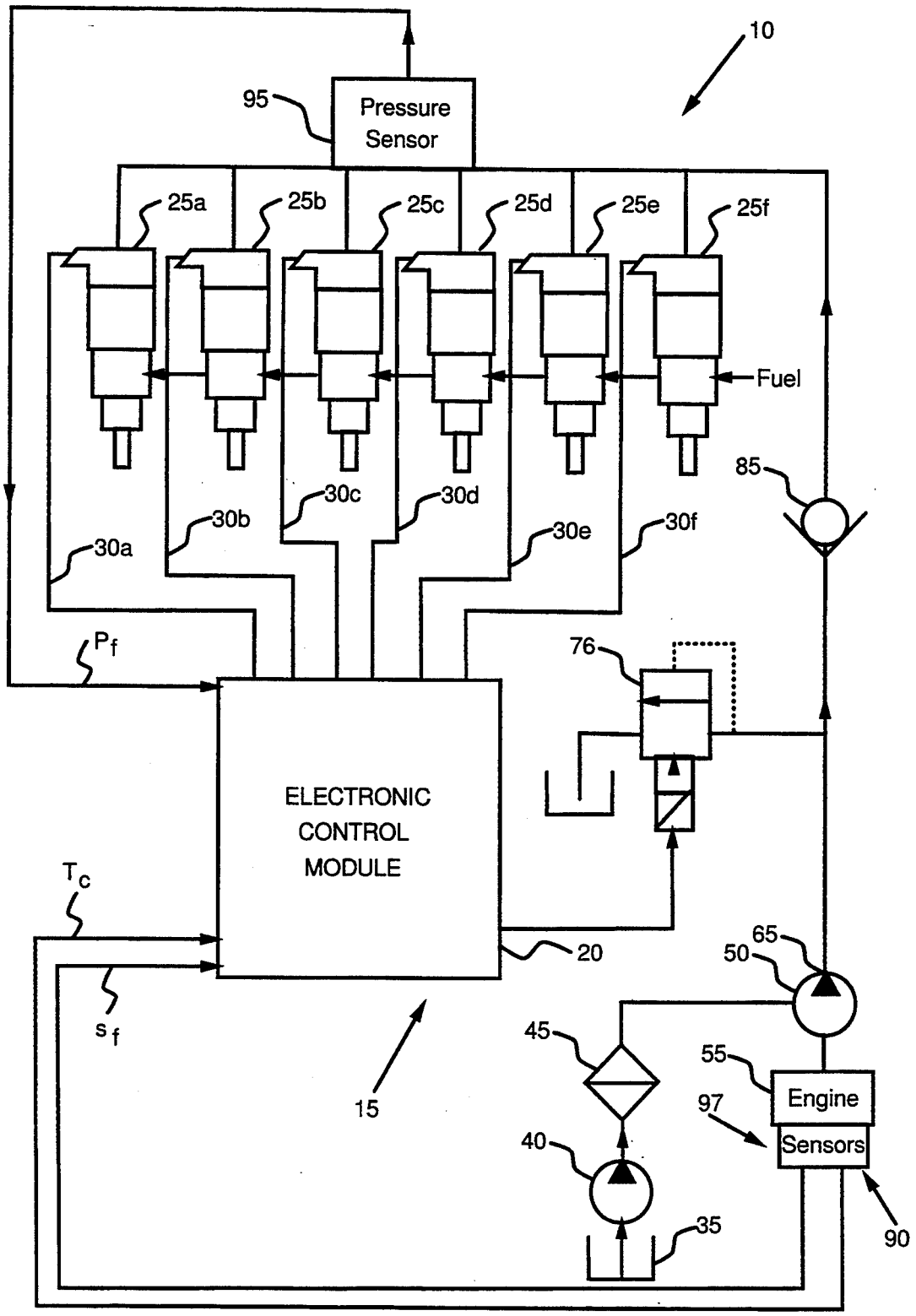
FIG. 1 is a diagrammatic general schematic view of a hydraulically-actuated electronically-controlled injector fuel system for an engine having a plurality of injectors.

Throughout the specification and figures, like reference numerals refer to like components or parts. Referring first to FIG. 1, a preferred embodiment of the electronic control system 10 for a hydraulically actuated electronically controlled unit injector fuel system is shown, hereinafter referred to as the HEUI fuel system. The control system includes an Electronic Control Module 15, hereinafter referred to as the ECM. In the preferred embodiment the ECM is a Motorolla microcontroller, model no. 68HC11. However, many suitable controllers may be used in connection with the present invention as would be known to one skilled in the art.

The electronic control system 10 includes hydraulically actuated electronically controlled unit injectors 25*a–f* which are individually connected to outputs of the ECM by electrical connectors 30*a–f* respectively. In FIG. 1, six such unit injectors 25*a–f* are shown illustrating the use of the electronic control system 10 with a six cylinder engine 55. However, the present invention is not limited to use in connection with a six cylinder engine. To the contrary, it may be easily modified for use with an engine having any number of cylinders and unit injectors 25. Each of the unit injectors 25*a–f* is associated with an engine cylinder as is known in the art. Thus, to modify the preferred embodiment for operation with an eight cylinder engine would require two additional unit injectors 25 for a total of eight such injectors 25.

Actuating fluid is required to provide sufficient pressure to cause the unit injectors 25 to open and inject fuel into an engine cylinder. In a preferred embodiment the actuating fluid comprises engine oil and the oil supply is the engine oil pan 35. Low pressure oil is pumped from the oil pan by a low pressure pump 40 through a filter 45, which filters impurities from the engine oil. The filter 45 is connected to a high pressure fixed displacement supply pump 50 which is mechanically linked to, and driven by, the engine 55. High pressure actuating fluid (in the preferred embodiment, engine oil) enters an Injector Actuation Pressure Control Valve 76, hereinafter referred to as the IAPCV. Other devices, which are well known in the art, may be readily and easily substituted for the fixed displacement pump 50 and the IAPCV. For example, one such device includes a variable pressure high displacement pump.

In a preferred embodiment, the IAPCV and the fixed displacement pump 50 permits the ECM to maintain a desired pressure of actuating fluid. A check valve 85 is also provided.

The ECM contains software decision logic and information defining optimum fuel system operational parameters and controls key components. Multiple sensor signals, indicative of various engine parameters are delivered to the ECM to identify the engine's current operating condition. The ECM uses these input signals to control the operation of the fuel system in terms of fuel injection quantity, injection timing, and actuating fluid pressure. For example, the ECM produces the waveforms required to drive the IAPCV and a solenoid of each injector 25.

The electronic control uses several sensors, some of which are shown. An engine speed sensor 90 reads the signature of a timing wheel applied to the engine camshaft to indicate the engine's rotational position and speed to the ECM. An actuating fluid pressure sensor 95 delivers a signal to the ECM to indicate the actuating fluid pressure. Moreover, an engine coolant temperature sensor 97 delivers a signal to the ECM to indicate engine temperature.

Figure 2:
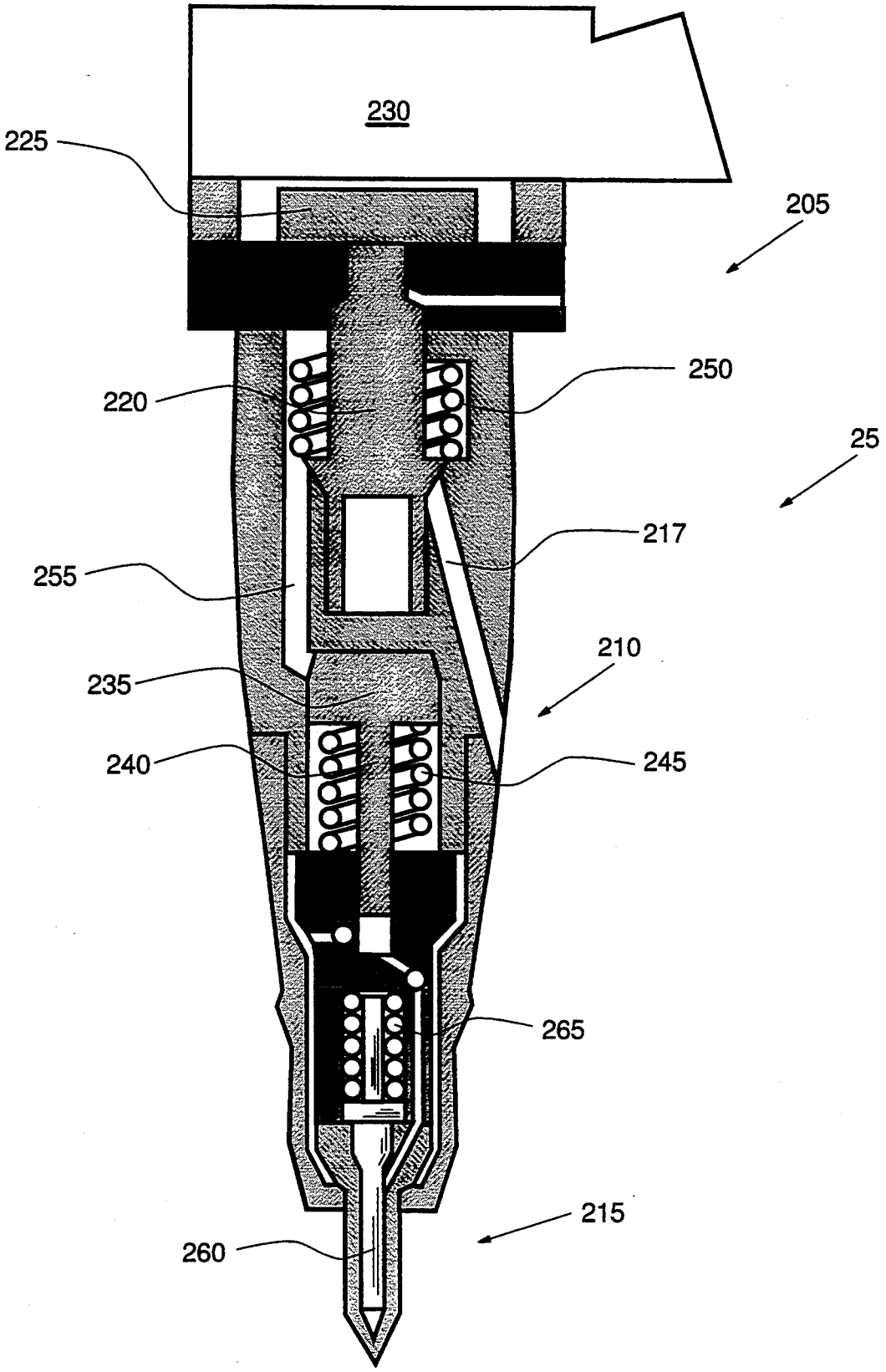
FIG. 2 is a cross sectional view of a hydraulically-actuated electronically-controlled injector for the fuel system of FIG. 1.

The injector operation will now be described with reference to FIG. 2. The injector 25 consists of three main components, a control valve 205, an intensifier 210, and a nozzle 215. The control valve's purpose is to initiate and end, the injection process. The control valve 205 includes a poppet valve 220, armature 225 and solenoid 230. High pressure actuating fluid is supplied to the popper valve's lower seat via passage 217. To begin injection, the solenoid is energized moving the poppet valve from the lower seat to an upper seat. This action admits high pressure fluid to a spring cavity 250 and to the intensifier 210 via passage 255. Injection continues until the solenoid is de-energized and the poppet moves from the upper to the lower seat. Fluid and fuel pressure decrease as spent fluid is ejected from the injector through the open upper seat to the valve cover area.

The intensifier 210 includes a hydraulic intensifier piston 235, plunger 240, and return spring 245. Intensification of the fuel pressure to desired injection pressure levels is accomplished by the ratio of areas between the intensifier piston 235 and plunger 240. Injection begins as high pressure actuating fluid is supplied to the top of the intensifier piston. As the piston and plunger move downward, the pressure of the fuel below the plunger rises. The piston continues to move downward until the solenoid is de-energized causing the popper 220 to return to the lower seat, blocking fluid flow. The plunger return spring 245 returns the piston and the plunger to their initial positions. As the plunger returns, it draws replenishing fuel into the plunger chamber across a ball check valve.

Fuel is supplied to the nozzle 215 through internal passages. As fuel pressure increases, a needle lifts from a lower seat allowing injection to occur. As pressure decreases at the end of injection, a spring 265 returns the needle to its lower seat.

Because of the physical characteristics of the fuel injector and the actuating fluid flow dynamics, at high actuating fluid viscosities and low actuating fluid pressures, multiple fuel injections may occur during the injection period.

More particularly, as the injector 25 dispenses fuel, the intensifier plunger 240 moves downward, which causes actuating fluid to flow into the control valve cavity 250. However, at high actuating fluid viscosities, actuating fluid flow losses develop, which decreases the actuating fluid pressure in the control valve cavity 250. If the pressure in the control valve cavity 250 drops below a predetermined value, the corresponding drop in fuel injection pressure will cause the needle 260 to close. However, as pressure builds in the control valve cavity, the fuel injection pressure will increase, causing the needle to open and once again dispense fuel. This repeated opening and closing of the needle may continue during the entire injection period causing fuel to be injected in a series of very short bursts. Consequently, multiple injection may provide many beneficial effects including lower emissions, reduced noise, reduced smoke, improved cold starting, white smoke clean-up, and high altitude operation.

Typically, engine starting includes three engine speed ranges. For example, from 0–200 RPM the engine is said to be cranking (cranking speed range). Once the engine fires, then the engine speed accelerates from engine cranking speeds to engine running speeds (acceleration speed range). Once the engine speed reaches a predetermined engine RPM, e.g. 900 RPM, then the engine is said to be running (running speed range). The present invention is concerned with controlling the fuel injection to start an engine where the engine is accelerating to running speed—especially where the engine temperature is below a predetermined temperature, e.g. 18° Celsius.

Figure 3:
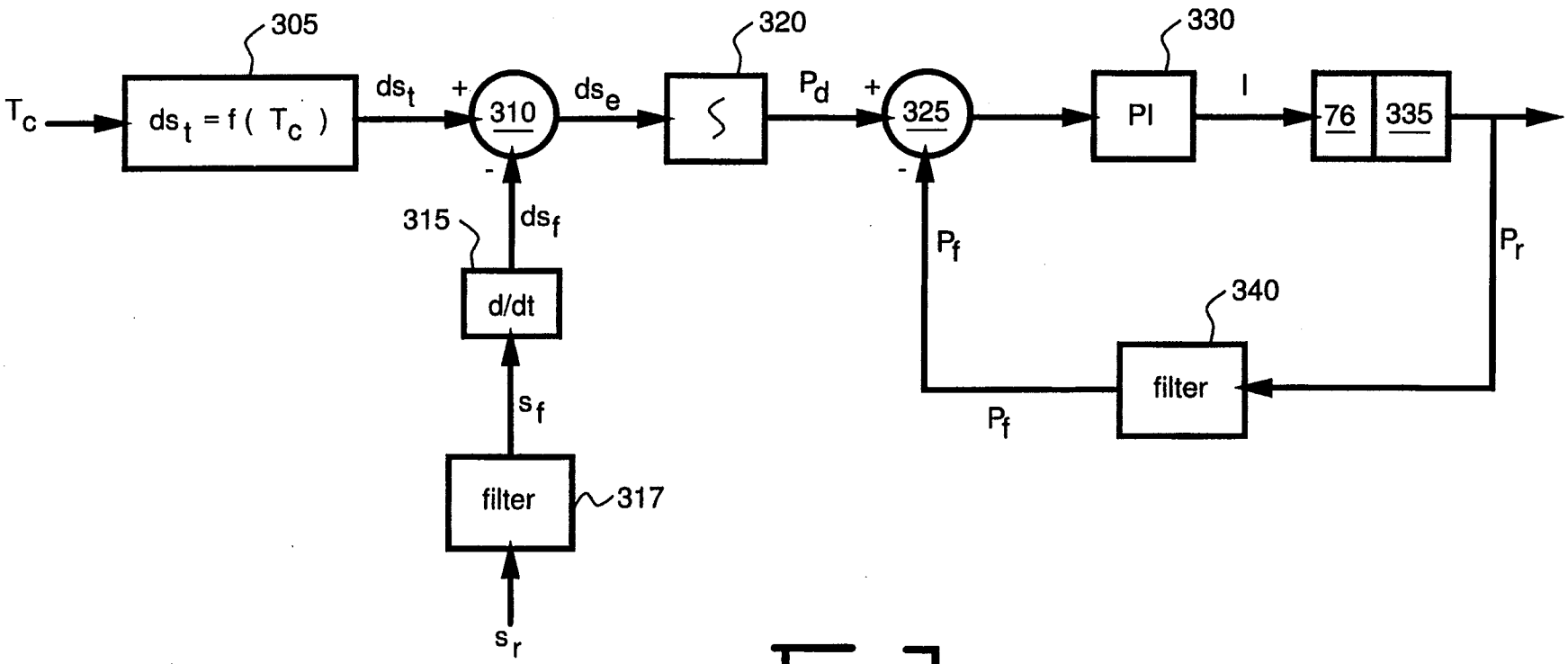
FIG. 3 is a block diagram of an actuating fluid pressure control strategy for the fuel system of FIG. 1, while the engine is accelerating, but not yet running.

The software decision logic for determining the magnitude of the actuating fluid pressure supplied to the injector 25, while the engine is firing, but not yet running, is shown with respect to FIG. 3. A target acceleration rate signal $ds_t$ is produced by block 305, which may includes a map(s) and/or equation(s). Preferably, the target acceleration rate signal $ds_t$ is a function of coolant temperature $T_c$. The target engine speed derivative signal $ds_t$ is then compared with the actual engine acceleration rate signal $ds_f$ at block 310, which produces an engine acceleration rate error signal $ds_e$. The actual engine acceleration rate signal $ds_f$ is produced by differentiating an actual engine speed signal $s_f$, at block 315. Preferably, the raw engine speed signal $s_r$ is conditioned and converted by a conventional means 317 to eliminate noise and convert the signal to a usable form.

The engine acceleration rate error signal $ds_e$ is converted into a desired actuating fluid pressure signal $P_d$, at block 320, in response to integrating the engine acceleration rate error signal $ds_e$. Note, the magnitude of the desired actuating fluid pressure signal $P_d$ may be limited to an upper magnitude commensurate with the pressure limits of the HEUI system, while the lower magnitude may be limited to the pressure at which the engine initially fired. The desired actuating fluid pressure signal $P_d$ is then compared, at block 325, with the actual actuating fluid pressure signal $P_f$ to produce an actuating fluid pressure error signal $P_e$.

The actuating fluid pressure error signal $P_e$ is input to a PI control block 330 whose output is a desired electrical current (I) applied to the IAPCV. By changing the electrical current (I) to the IAPCV the actuating fluid pressure $P_f$ can be increased or decreased. The PI control 330 calculates the electrical current (I) to the IAPCV that would be needed to raise or lower the actuating fluid pressure $P_f$ to result in a zero actuating fluid pressure error signal $P_e$. The resulting actuating fluid pressure is used to hydraulically actuate the injector 25. Preferably, the raw actuating fluid pressure signal $P_r$ in the high pressure portion of the actuating fluid pressure circuit 335 is conditioned and converted by a conventional means 340 to eliminate noise and convert the signal to a usable form. Although a PI control is discussed, it will be apparent to those skilled in the art that other controlled strategies may be utilized.

Figure 4:
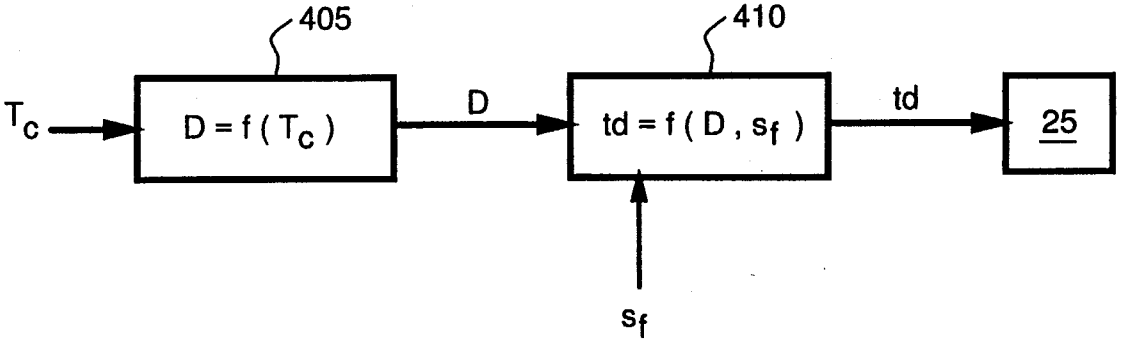
FIG. 4 is a block diagram of a time duration control strategy over which fuel is injected for the fuel system of FIG. 1, while the engine is accelerating, but not yet running.

The software decision logic for determining the time duration over which fuel is injected by each injector 25 while the engine is firing, but not yet running, is shown with respect to FIG. 4. Preferably, the actual engine coolant temperature signal $T_c$ is input into block 405, may include a map(s) and/or equation(s). Based on the magnitude of the coolant temperature, a cranking duration limit signal D is selected as an output. The cranking duration limit signal D represents the period, in angular degrees, over which fuel is to be injected. The cranking duration limit signal D, along with an actual engine speed signal is input into block 410, which converts the cranking duration limit signal D into a time duration signal $t_d$ expressed in temporal units, e.g., milliseconds. The time duration signal $t_d$ is used to determine how long the current (I) to the solenoid of a respective injector 25 should remain "on" to inject the correct quantity of fuel.

Thus, while the present invention has been particularly shown and described with reference to the preferred embodiment above, it will be understood by those skilled in the art that various additional embodiments may be contemplated without departing from the spirit and scope of the present invention.

Industrial Applicability

The subject invention electronically controls the fuel injection rate and fuel injection duration to start an engine. More particularly, the present invention is adapted to increase the injection rate while the engine is accelerating to running speeds in order to achieve quicker starting. Because the time period in which to inject fuel decreases, as engine speed increases, the injection rate must be increased accordingly. Consequently, the present invention increases the fuel injection rate by increasing the actuating fluid pressure to a achieve a desired quantity of fuel to accelerate the engine at a desired acceleration rate.

The present invention determines the engine speed acceleration, and compares the engine speed acceleration to a target acceleration value to determine a desired actuating fluid pressure to control the fuel injection rate. Advantageously, the target engine speed acceleration is a function of temperature to account for the combustion characteristics of the engine. Consequently, the desired actuating fluid pressure results in an injection rate that is neither too slow which inhibits engine acceleration, nor too fast which quenches combustion.

Moreover, in a HEUI fuel system, the injection rate is responsive to the actuating fluid pressure and viscosity. Accordingly, the acceleration rate is responsive to viscosity. For example, the higher the viscosity, the greater amount of pressure is required to result in the desired acceleration rate; conversely, the lower the viscosity, the lessor amount of pressure is required to result in the desired acceleration rate.

Other aspects, objects and advantages of the present invention can be obtained from a study of the drawings, the disclosure and the appended claims.

I claim:

1. A method for controlling a hydraulically-actuated injector (25) to start an internal combustion engine (55), comprising the steps of:

determining an actual acceleration rate of the engine, comparing the acceleration rate to a target acceleration rate, and producing an acceleration rate error signal $ds_e$ in response to the comparison;

receiving the acceleration rate error signal $ds_e$, and producing a desired actuating fluid pressure signal ($P_d$); and receiving the desired actuating fluid pressure signal ($P_d$), determining a desired electrical current, and producing a desired electrical current signal (I) to control the fuel injection rate.

2. A method, as set forth in claim 1, including the steps of:

sensing the temperature of the engine and producing a engine temperature signal ($T_c$) indicative of the temperature of actuating fluid used to hydraulically actuate the injector (25);

sensing the engine speed and producing an engine speed signal ($s_f$) indicative of the sensed engine speed; and receiving the engine speed and temperature signals ($s_f$,$T_c$), determining the target acceleration rate based on the magnitude of the engine speed and temperature signals, and producing a target acceleration rate signal ($ds_t$) indicative of the target acceleration rate.

3. A method, as set forth in claim 2, including the steps of receiving the engine speed signal ($s_f$), determining the actual engine acceleration rate in response to differentiating the engine speed signal, and producing an actual engine acceleration rate signal ($ds_f$) indicative of the actual acceleration rate.

4. A method, as set forth in claim 3, including the steps of receiving the target and actual acceleration rate signals ($ds_t$,$ds_f$), and producing the acceleration rate error signal ($ds_e$) in response to the difference between the target and actual acceleration rate signals ($ds_t$,$ds_f$).

5. A method, as set forth in claim 4, including the steps of:

sensing an actual actuating fluid pressure and producing an actual actuating fluid pressure signal ($P_f$) indicative of sensed actuating fluid pressure;

comparing the desired actuating fluid pressure signal ($P_d$) with the actual actuating fluid pressure signal ($P_f$) and producing an actuating fluid pressure error signal ($P_e$) in response to a difference between the compared actuating fluid pressure signals ($P_d$,$P_f$); and receiving the actuating fluid pressure error signal ($P_e$), determining the desired electrical current based on the actuating fluid pressure error signal ($P_e$), and producing the desired electrical current signal (I).

6. A method, as set forth in claim 5, wherein the desired fluid pressure is determined to cause the fuel injector (25) to produce a plurality of injections during an injection period.

* * * * *